United States Patent [19]

Shaylor

[11] 4,132,309

[45] Jan. 2, 1979

[54] HOSIERY PACKAGE

[75] Inventor: Harold H. Shaylor, Westfield, Mass.

[73] Assignee: Westvaco Corporation, New York, N.Y.

[21] Appl. No.: 868,871

[22] Filed: Jan. 12, 1978

[51] Int. Cl.[2] ..... B65D 85/18; H41D 27/22

[52] U.S. Cl. ..... 206/278; 206/460; 206/806; 206/813; 223/87

[58] Field of Search ..... 206/278, 281, 806, 460, 206/813; 229/87 A; 223/87

[56] References Cited

U.S. PATENT DOCUMENTS

| | | | |
|---|---|---|---|
| 2,816,653 | 12/1957 | Jacobi | 206/281 |
| 2,855,649 | 10/1958 | Kanter | 223/87 |
| 3,329,386 | 7/1967 | Rosen | 223/87 UX |
| 3,370,765 | 2/1968 | Jossen | 223/87 |

*Primary Examiner*—William T. Dixson, Jr.

[57] ABSTRACT

A combination label, hosiery package and hanger for hosiery comprises an elongated blank of paperboard or the like which is printed on one side with advertising and identification graphics and coated on the opposite side with a pressure sensitive adhesive. The elongated blank is divided by a pair of equally spaced, vertically oriented score lines into three primary panels of substantially equal size and shape to form a centrally located back panel and a pair of outboard side panels. The outboard side panels are further divided into pairs of subpanels by cut lines for accommodating the bulk of the packaged hose. For packaging the hose, the primary panels of the blank are folded along the vertically oriented scope lines into superposed relation about a pair of hosiery wherein the pressure sensitive adhesive coated side of the blank comes into contact with and adheres the hosiery into a matching pair. Meanwhile, the upper portion of the panels are provided with cutouts which coincide with one another in their superposed relation to provide a hook like opening for hanging the package on the pin element of a pin type display panel.

3 Claims, 8 Drawing Figures

33
31
12
13

HOSIERY PACKAGE

BACKGROUND OF INVENTION

The use of hanging packages made from stiff material such as paperboard, plastic and the like are well known in the art, particularly for the display of clothing, hardware and other goods on point-of-purchase displays. Generally, these packages take the form of blister packs mounted on paperboard, envelopes provided with paperboard stiffeners and other combinations of paperboard and plastic, all of which usually contain an opening or hook for suspending the package from a pin element on a point-of-purchase display. However, prior art packages for socks, hosiery and other related goods have generally been formed by paperbands applied either with a water soluble gum or a pressure sensitive adhesive in combination with a plastic hook at the heel gore, or, by nonadhesive paperboard packages including window areas, and which incorporate a hook or other pin element suspending opening.

The following list of United States patents illustrate some of the prior art packages used for hosiery, clothing and other items:

U.S. Pat. No. 2,816,653 (206/46)
U.S. Pat. No. 3,029,938 (206/79)
U.S. Pat. No. 3,227,268 (206/46)
U.S. Pat. No. 3,252,567 (206/46)
U.S. Pat. No. 3,414,175 (223/85)

As will be seen from the above noted prior art, packages for hosiery have included forms around which the hose are folded with alternate complete enclosures or combination labels and end protectors. Meanwhile, the prior art also shows hanger devices, folded display mounts and protective covers for articles of clothing and hardware that can be suspended on point-of-purchase displays. However, a careful review of the prior art will show that none of the previous efforts provide a package that offers the convenience, simplicity and economy of the package of the present invention.

SUMMARY OF INVENTION

It is the general purpose of the present invention to provide a one piece package for displaying hosiery or the like on point-of-purchase displays. The package serves the several purposes of providing a label for identifying the goods, keeping a matched pair of the goods from becoming separated, and includes an integral means for suspending the package on the pin element of a pin type display panel. In this regard, the package of the present invention is intended to replace the separate bands and plastic heel gore hooks generally used in the past for hanging hosiery on pin type displays.

The package of the present invention comprises essentially a label or the like which is cut and scored for encircling and retaining together a matched pair of hose. The label element is printed on one side thereof with suitable graphics and product identification information and is coated on the opposite side with a pressure sensitive adhesive which is effective to adhere the goods to the label element and the label element together. The label element is manufactured with well known die cutting techniques wherein a blank is cut and scored for the particular goods to be packaged. The labels are printed and coated with a pressure sensitive adhesive, and the label elements in blank form are stored on a backing layer of release paper from which the individual labels are separated for use. In use, the labels are preferably automatically stripped from the release paper and applied to the goods by simple folding operations on automatic machinery. When applied to the goods, the labels adhesively retain the goods together for shipment to the retailer. The retailer subsequently uses the integral hanger means incorported within the label for displaying the goods on point-of-purchase displays.

Accordingly, it is an object of the present invention to provide a combination label, hosiery package and hanger means which may be conveniently applied to a pair of hose to provide a means for making available product identification and advertising graphics to the consumer, retaining a matched pair of the hose in a single package and suspending the package on the pin element of a pin type point-of-purchase display.

Another object of the invention is the provision of a combination label, hosiery package and hanger, which label may be used in flat blank form and applied directly to the hosiery by simple folding operations wherein parts of the label are secured directly to the hosiery being packaged and other parts are secured directly to one another to achieve the final package.

A further object of the present invention is the provision of a combination label, hosiery package and hanger which may be conveniently and economically manufactured by a relatively simple die cutting procedure from sheet material such as paper, paperboard, plastics or the like, and which is divided into primary panels which when folded into superposed relation embrace the hosiery and retain matching pairs in individual packages.

A still further object of the invention is the provision of a combination label, hosiery package and hanger which includes integral openings or hook-like cutouts at one end thereof for suspending the packaged hosiery on pin elements disposed on point-of-purchase displays.

DETAILED DESCRIPTION

Figure 1:
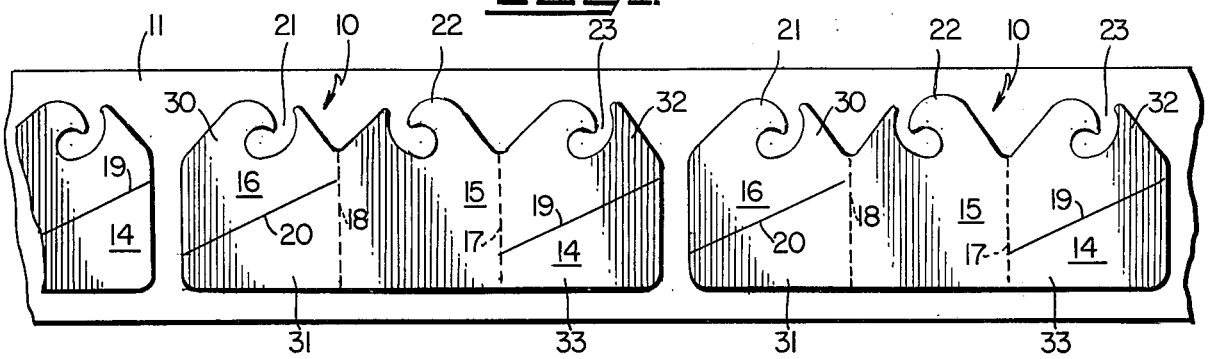
FIG. 1 is a plan view showing several of the combined labels, hosiery packages and hangers of the present invention adhered to a strip of release paper.
Figure 2:
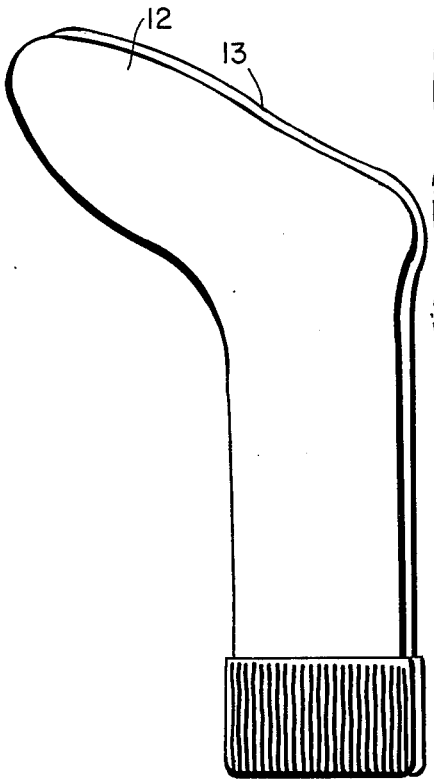
FIG. 2 shows a typical pair of hosiery for which the package of the present invention is intended.

Referring to FIG. 1 of the drawing, a strip of release paper 11 is shown on which is mounted several of the combined labels, hosiery packages and hangers 10 of the present invention. In a preferred method of manufacture, the combined release paper 11 and paperboard strip from which the blanks 10 are prepared is operated on with suitable die cutting apparatus to cut and score the paperboard strip into a plurality of blanks 10. The blanks are printed either before or after the die cutting operation and then waste material between and around the individual blanks 10 is stripped away. Prior to die cutting operation, the paperboard strip is coated on the backside thereof with a suitable pressure sensitive adhesive which can be adhered to the hosiery, to itself, and/or to an uncoated portion of the blank. Then, with the strip adhered to the release paper, the die cutting operation is designed to cut through the paperboard strip only without cutting the release paper. After printing, die cutting and stripping, the release paper with hosiery package blanks adhered thereto is either stored in roll form or in a bi-folded condition for shipment to the user.

Figure 3:
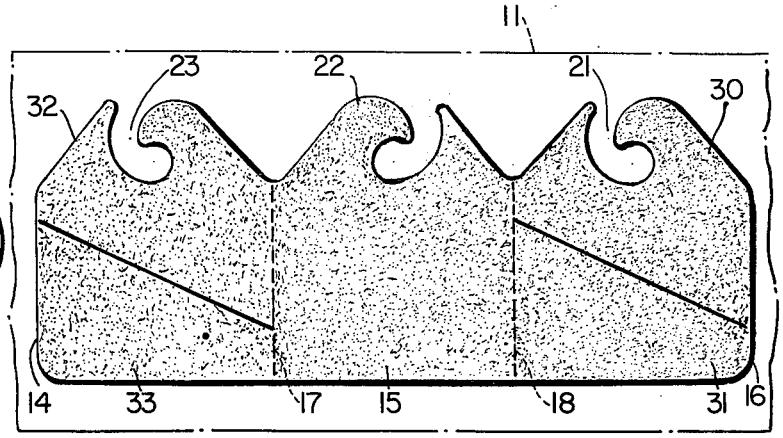
FIG. 3 shows a single hosiery package of the present invention turned with its adhesive coated side up.

Blank 10 is divided into three contiguous primary panels 14,15,16 by a pair of vertically oriented score lines 17,18. The primary panels 14,15,16 are preferably of substantially the same size and shape as determined by the size and bulk of the hose to be packaged. Meanwhile, the two outboard panels 14,16 are each further divided into subpanels by cut lines 19,20. As shown in FIGS. 1 and 3, the cut lines 19,20 are angularly disposed in the panels 14,16 so as to bisect each panel into two generally triangular subpanels 30,31 and 32,33. The angular orientation of the fold lines 19,20 corresponds to the angular orientation of the fold at the heel gore of the hose when the folded hose are disposed vertically. Where tube type hose are to be packaged, i.e., hose without a heel portion, the cut lines 19,20 are arranged substantially horizontally in panels 14,16 to correspond with the fold in the hose. The purpose of the cut lines 19,20 is to provide some flex to the package particularly when the hose are bulky. In some cases, for instance, where the hose are extremely bulky, the size of the panels 14,16 and the orientation of the cut lines 19,20 may be altered to accomodate the product. In addition to the above, each of the primary panels 14,15,16 have hook-like cut outs 21,22,23 at their upper edges which together form the integral hanger elements of the combination label and hosiery package. The cut outs 21,22,23 are sized and shaped to coincide with one another when the primary panels 14,15,16 are folded into superposed relation around the packaged hose. Obviously, the shape and size of the cut outs 21,22,3 depends on the type and size of display involved.

Figure 4:
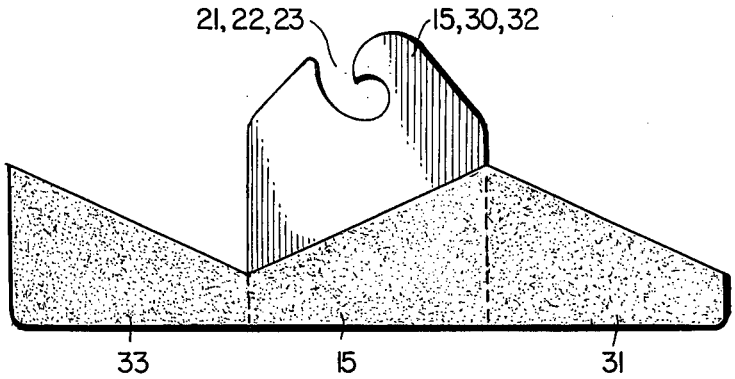
FIG. 4 shows a first folding step in the preferred method for forming the package of the present invention.
Figures 5, 6, 7, 8:
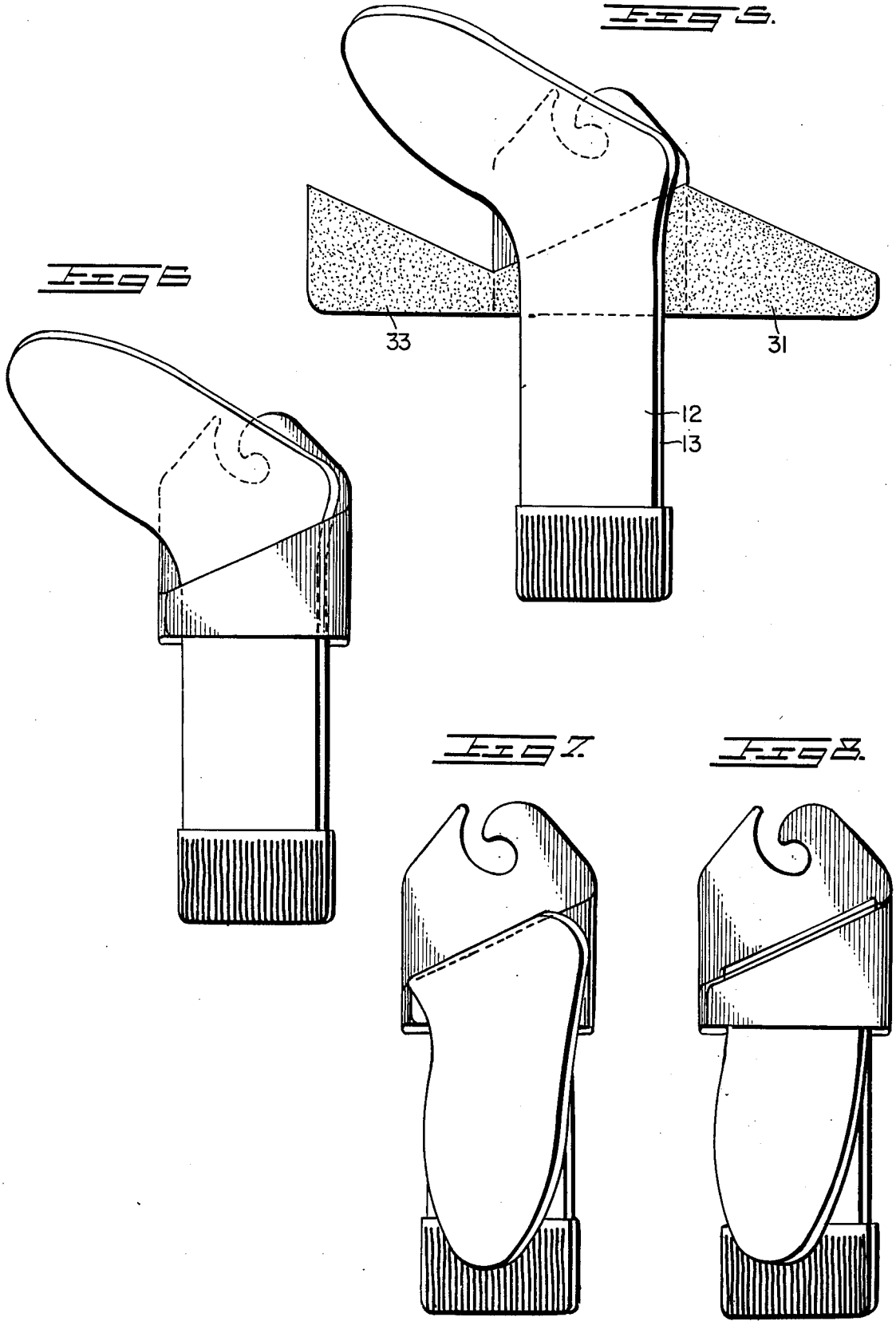
FIG. 5 shows the blank of FIG. 4 with a pair of hosiery in place.
FIG. 6 shows the second folding step for forming the package of the present invention.
FIG. 7 shows the final package ready for mounting on a pin display.
FIG. 8 shows a second embodiment of the present invention.

The package is assembled when a single blank 10 is removed from the release paper 11 and turned so the adhesive coated side is up as shown in FIG. 3. This step can be carried out by hand or with suitable mechanical equipment. Similarly, the first folding step can be performed by hand or with suitable mechanical equipment by folding subpanels 30 and 32 over into superposed relation as shown in FIG. 4. Because the adhesive applied to the blanks is of the pressure sensitive type, with the characteristic that it may be adhered to itself, to the hose or to uncoated surfaces of the blank, the first folding step serves to adhere each of the subpanels 30 and 32 to panel 15 to form the upper blank suspending portion of the package. Subsequently, as shown in FIG. 5, a matched pair of hose 12,13 is placed on the centrally located panel 15 so that one of the hose becomes adhered to the adhesive coated side of panel 15. This step sets up the package for the second folding steps shown in FIG. 6, which are accomplished when subpanels 31 and 33 are folded around the hose to first secure one of the subpanels to the unsecured hose of the pair and the second subpanel to the first subpanel. These latter folding steps securely attach both hose to the different panels of the package to prevent loss and thereby retain a matched pair of hose together. Similarly, the angular nature of the upper edges of the subpanels 31,33 tends to coincide with an imaginary fold line through the heel gore of the hose and about which the hose may be conveniently folded to enable both the foot portions of the hose and the ankle portions of the hose to lie one on top of the other. Accordingly, when the hose are folded about the heel gore, a package is achieved as shown in FIG. 7. It may be seen from a casual consideration of FIG. 7 that the final package is neat, convenient and ready for display on the pin element of a typical point-of-purchase display.

Obviously, however, the package of the present invention is not limited to the method of assembly just described. For instance, where tube type socks are to be packaged, the cuts at 19 and 20 in blank 10 are substantially horizontal and not angularly disposed. Moreover, if desired, a pair of hose may be packaged in side-by-side relationship using the package of the present invention. The latter packaging technique requires that the two hose of a pair be pre-folded individually about their respective heel gores. Then, with the blank as shown in FIG. 4, a first hose of the pair is adhered to the exposed adhesive coated surface of panel 15 with the fold lying coincident with the angular cut edges 19,20. Subsequently, one of the subpanels 31 or 33 is folded over and adhered to the first hose, or, in the alternative, the second hose of the pair is simply placed directly on the first hose before folding over the subpanels 31 and 33. The second folding steps, in either case, tend to adhere the second hose of the pair to one of the subpanels 31 or 33 and achieve a package substantially as shown in FIG. 8. The advantage of the package configuration shown in FIG. 8 as compared with that of FIG. 7, is that the printed surface of one of the subpanels 31 or 33 is exposed to the sight of a potential buyer. Thus, information or graphics printed on the exposed subpanel is more readily accessible than in the FIG. 7 configuration. It will be appreciated, moreover, that a pair of nested and folded hose may also be packaged as shown in FIG. 8. In such a case, with the hose and package in the state of assembly shown in FIG. 5, the method assembly is as follows. First, one of the subpanels 31 or 33 is folded over and adhered to the unadhered hose of the pair. In this condition, each of the hose of a pair are adhered to one of the subpanels 31 or 33 and to the centrally located panel 15. Secondly, the paired hose are folded over along the heel gore and about the angular cut edge of the first folded subpanel. Thirdly, the second subpanel 31 or 33 is folded over and adhered to the then folded surface of the hose. Accordingly, it may be seen that the package of the present invention is versatile, convenient and economical as a replacement for the presently used band element and plastic gore hook element for hosiery. Further, from the illustrations shown in FIGS. 7 and 8, it will be apparent that the foregoing construction affords a number of advantages. The blank 10 when folded about the hosiery 12,13 provides ample space for graphics which identify the product and promote the sale thereof through printed advertisements. In addition, because of the nature of the adhesive used on blank 10 the paired hose 12,13 become firmly attached to the panels 14,15,16 when they are folded into superposed relation about the hosiery. This feature substantially reduces the possibility that one or more of the hose will become separated after the package is secured and during shipment to the retailer. Meanwhile, the cutouts 21,22,23 permit the retailer to hang the hosiery from a pin type point-of-purchase display in a manner that is attractive and convenient for sale.

Accordingly, the invention herein comprises the elements, features of construction and arrangement of parts as exemplified in the foregoing specification. However, it should be understood that the invention is not to be limited by the specific example fully disclosed herein, as there may be changes made without departing from the principles of the invention as defined in the accompanying claims:

I claim:

1. In combination, a pair of hosiery and means for packaging said hosiery for display on a pin type display rack comprising, an elongated blank of paperboard or the like having a continuous coating of pressure sensitive adhesive applied to one side thereof, said adhesive having the characteristic whereby it can be adhered to the hosiery, to itself, and/or to an uncoated portion of the blank, a pair of spaced apart and parallel score lines in said blank which divide the blank into a centrally located back panel having an upper portion and a lower portion and a pair of outboard side panels each of substantially the same size and shape, a pair of cut lines in said outboard side panels which divide said panels into a first pair of upper subpanels and a second pair of lower subpanels, the upper subpanels and the upper portion of said back panel each being provided with hook-shaped cutouts for accomodating the pin element of a pin type display rack, wherein the adhesive coated surfaces of said upper subpanels are bonded to one another and to the upper portion of said back panel to bring the cutouts into aligned condition and the adhesive coated surfaces of said lower subpanels are bonded to one another and to a pair of hosiery adhered to the lower portion of said back panel to encircle and retain together a matched pair of said hosiery.

2. The combination of claim 1 wherein the cut lines in said outboard side panels are angularly oriented to form substantially triangularly shaped lower subpanels.

3. A method of packaging hosiery comprising:

(a) providing a combined label, hosiery package and hanger in the form of a blank of paperboard or the like that is divided into panels and coated on one side thereof with a continuous coating of pressure sensitive adhesive, said adhesive having the characteristic whereby it can be adhered to the hosiery, to itself, and/or to an uncoated portion of the blank, and said blank being characterized as having a centrally located back panel with upper and lower portions and a pair of outboard side panels each divided into upper and lower subpanels;

(b) arranging said blank with the adhesive coated side up for packaging said hose;

(c) bonding the adhesive coated surfaces of said upper subpanels to one another and to the upper portion of said back panel;

(d) placing a matching pair of hosiery in side-by-side relation on the adhesive coated surface of the lower portion of said centrally located back panel and adhering one of the hose of said pair to said centrally located panel;

(e) folding one of the lower subpanels of said blank over said pair of hose to adhere the other hose of said pair to said one folded lower subpanel; and, (f) folding the other of said lower subpanels of said blank over said one lower subpanel to adhere said two lower subpanels together.

* * * * *